US010688777B2

(12) United States Patent
Oku et al.

(10) Patent No.: US 10,688,777 B2
(45) Date of Patent: Jun. 23, 2020

(54) PLATE CYLINDER

(71) Applicant: SHOWA ALUMINUM CAN CORPORATION, Tokyo (JP)

(72) Inventors: Tomohiro Oku, Tokyo (JP); Toshihiko Onishi, Tokyo (JP); Toru Kitagawa, Tokyo (JP); Hitoshi Tojima, Tokyo (JP)

(73) Assignee: SHOWA ALUMINUM CAN CORPORATION, Tokyo (JP)

( * ) Notice: Subject to any disclaimer, the term of this patent is extended or adjusted under 35 U.S.C. 154(b) by 0 days.

(21) Appl. No.: 15/548,892

(22) PCT Filed: Feb. 23, 2016

(86) PCT No.: PCT/JP2016/055197
§ 371 (c)(1),
(2) Date: Aug. 4, 2017

(87) PCT Pub. No.: WO2016/152360
PCT Pub. Date: Sep. 29, 2016

(65) Prior Publication Data

US 2018/0037021 A1 Feb. 8, 2018

(30) Foreign Application Priority Data

Mar. 24, 2015 (JP) ..... 2015-060594

(51) Int. Cl.
*B41F 13/10* (2006.01)
*B41F 27/12* (2006.01)
(Continued)

(52) U.S. Cl.
CPC ..... *B41F 13/10* (2013.01); *B41F 27/005* (2013.01); *B41F 27/06* (2013.01); *B41F 27/10* (2013.01);
(Continued)

(58) Field of Classification Search
CPC ..... B41F 27/12; B41F 27/10; B41F 27/105; B41F 27/00; B41F 27/1262;
(Continued)

(56) References Cited

U.S. PATENT DOCUMENTS 4,150,622 A 4/1979 Stollenwerk et al.
4,917,013 A 4/1990 Katz
(Continued)

FOREIGN PATENT DOCUMENTS

DE 2740634 A1 3/1978
DE 102004001398 A1 8/2008
(Continued)

OTHER PUBLICATIONS

International Search Report dated May 24, 2016 issued in corresponding PCT/JP2016/055197 application (2 pages).
(Continued)

*Primary Examiner* — David H Banh
(74) *Attorney, Agent, or Firm* — Millen, White, Zelano & Branigan, P.C.; William Nixon

(57) ABSTRACT

A plate cylinder enables a printing plate to be attached thereto and is improved in strength. A plate cylinder is attached to a rotationally driven plate driving shaft, and is configured to mount a cylindrical printing plate attached thereon from a tip end side thereof. The plate cylinder is provided with a plate cylinder main body having a plate mounting surface to which the printing plate is attached. A flat portion is formed on a flat surface positioned further toward a radially inner side than the plate mounting surface. A plurality of hole portions is formed side by side in an axially separated state in the flat portion. A plurality of plate fixing members tightly fixes the printing plate to the plate mounting surface. The plate fixing members are fitted into
(Continued)

the hole portions, and are provided to be movable in radially inward and outward directions of the plate cylinder.

7 Claims, 7 Drawing Sheets

(51) Int. Cl.
*B41F 27/00* (2006.01)
*B41F 27/10* (2006.01)
*B41F 27/06* (2006.01)
*B41F 17/22* (2006.01)

(52) U.S. Cl.
CPC ..... *B41F 27/105* (2013.01); *B41F 27/1206* (2013.01); *B41F 27/1212* (2013.01); *B41F 17/22* (2013.01); *B41P 2227/21* (2013.01)

(58) Field of Classification Search
CPC ..... B41F 27/1218; B41F 27/1212; B41F 27/005; B41F 27/06; B41F 13/10; B41F 27/1206; B41F 17/22; B41P 2227/21
See application file for complete search history.

(56) References Cited

U.S. PATENT DOCUMENTS 5,168,808 A 12/1992 Prem
5,184,554 A * 2/1993 Merkel ..... B41F 27/1231 101/378
2002/0002920 A1* 1/2002 Dilling ..... B29C 44/1242 101/368
2002/0056387 A1* 5/2002 Kolbe ..... B41F 13/10 101/375
2005/0061177 A1* 3/2005 Salvestro ..... B41F 27/105 101/376
2013/0263750 A1* 10/2013 Minoshima ..... B41F 27/1218 101/383

FOREIGN PATENT DOCUMENTS

| | | | |
|---|---|---|---|
| EP | 1634703 | A2 | 3/2006 |
| GB | 929081 | A | 6/1963 |
| GB | 1587956 | A | 4/1981 |
| JP | 40-15708 | B1 | 7/1965 |
| JP | 5-64873 | A | 3/1993 |
| JP | 2010-42531 | A | 2/2010 |
| JP | 2010-173315 | A | 8/2010 |
| WO | 2012/046618 | A1 | 4/2012 |

OTHER PUBLICATIONS

English Abstract of DE 102004001398 A1 published Aug. 4, 2005.
English Abstract of JP 2010-042531 A published Feb. 25, 2010.
Supplementary European Search Report dated Aug. 7, 2018 issued in corresponding EP 16768263 application (7 pages).
Japanese Office Action dated Aug. 28, 2018 issued in corresponding JP 2015-060594 application (3 pages).
English Abstract of JP 2010-173315 A published Aug. 12, 2010.

* cited by examiner (b)

(a)

PLATE CYLINDER

FIELD OF THE INVENTION

The present invention relates to a plate cylinder for mounting a printing plate used for printing on a metallic can, particularly an aluminum or aluminum alloy can.

TECHNICAL BACKGROUND

Conventionally, a plate mounting device equipped with a plate cylinder is known. The plate cylinder is formed in a cylindrical shape and mounted on a plate driving shaft in a fixed manner. The plate cylinder is configured to mount a cylindrically formed printing plate from the tip end side of the plate cylinder on an outer peripheral surface thereof.

Patent Document 1 discloses a plate cylinder. The plate cylinder is equipped with a recess and a plate fixing member. The recess is formed in an elongated rectangular shape extending in the axial direction over the large part of the axial length of the plate cylinder and has a rectangular cross-sectional shape. The plate fixing member is configured to push a non-plate portion of a plate mounted on a plate cylinder portion from a radially inner side toward a radially outer side to thereby closely fix the plate to a plate mounting surface of the plate cylinder portion.

The plate fixing member is configured to be fitted in the recess substantially with no gap in the circumferential direction and the axial direction thereof so as to move in a radial direction of the plate cylinder along both circumferential side walls and both axial end walls of the recess.

PRIOR ART DOCUMENTS

Patent Document

[Patent Document 1] Japanese Unexamined Laid-open Patent Application Publication No. 2010-42531

SUMMARY OF THE INVENTION

Problems to be Solved by the Invention

However, in the plate cylinder described in Patent Document 1, since the recess in which the plate fixing member is fitted is formed over the large part of the axial length of the plate cylinder, there is a problem that the strength of the outer peripheral surface of the plate cylinder deteriorates.

In particular, in the case of a plate cylinder in which a hollow space is formed inside for the purpose of weight reduction, etc., there were large harmful influences, such as, e.g., occurrence of deflection at the outer peripheral surface of the plate cylinder, due to the decreased strength. Particularly, in cases where thinning was performed for further weight reduction, the influence of the reduction in strength was significant.

Means for Solving the Problems

In view of the aforementioned technical background, the present invention aims to provide a plate cylinder capable of easily mounting a printing plate thereon and improved in strength.

That is, the present invention has the configurations as described in the following Items [1] to [7].

[1] A plate cylinder to be attached to a rotationally driven plate driving shaft and configured to mount a cylindrical printing plate thereon from a tip end side of the plate cylinder, the plate cylinder comprising:

a plate cylinder main body having a plate mounting surface on which the printing plate is to be mounted;

a flat portion formed into a flat surface positioned radially inner than the plate mounting surface;

a plurality of hole portions formed in the flat portion side by side in an axial direction in a separated state; and a plurality of plate fixing members configured to closely fix the printing plate to the plate mounting surface, wherein the plate fixing member is fitted in the hole portion so as to be movable radially inward and outward of the plate cylinder.

[2] The plate cylinder as recited in the aforementioned Item [1], wherein the plate fixing member is configured such that an outer peripheral surface of the plate fixing member is movable within a range inner than an inner surface of the printing plate mounted on the plate mounting surface.

[3] The plate cylinder as recited in the aforementioned Items [1] or [2], wherein the plate fixing member is configured to be fixable at an arbitrary position within a range inner than an inner surface of the printing plate mounted on the plate mounting surface.

[4] The plate cylinder as recited in any one of the aforementioned Items [1] to [3], wherein an inner portion of the plate cylinder is formed in a hollow shape.

[5] The plate cylinder as recited in any one of the aforementioned Items [1] to [4], wherein the plate cylinder main body is provided with an air ejection hole at a position away from a tip end side by 20 mm to 50 mm, and a surface roughness Ra of the plate cylinder main body is set to 0.025 μm to 0.5 μm.

[6] The plate cylinder as recited in the aforementioned Item [5], wherein a plurality of the air ejection holes is formed in a tip end side of the plate cylinder main body along a circumferential direction thereof.

[7] A method of attaching and detaching a printing plate with respect to the plate cylinder as recited in the aforementioned Items [5] or [6], wherein attaching and detaching the printing plate with respect to the plate cylinder is performed while ejecting air through the air ejection hole.

Effects of the Invention

According to the invention as described in the aforementioned Item [1], a plate cylinder to be attached to a rotationally driven plate driving shaft and configured to mount a cylindrical printing plate from a tip end side of the plate cylinder, includes a plate cylinder main body having a plate mounting surface on which the printing plate is to be mounted, a flat portion formed into a flat surface positioned radially inner than the plate mounting surface, a plurality of hole portions formed in the flat portion side by side in an axial direction in a separated state, and a plurality of plate fixing members configured to closely fix the printing plate to the plate mounting surface. The plate fixing member is fitted in the hole portion so as to be movable radially inward and outward of the plate cylinder. Due to the configuration in which the plurality of hole portions are provided in the separated state, a connected portion is provided between adjacent hole portions. As a result, the strength of the flat portion of the plate cylinder can be increased, and the printing plate can be easily fixed to the plate mounting surface.

According to the invention as described in the aforementioned Item [2], the plate fixing member is configured such that an outer peripheral surface of the plate fixing member is movable within a range inner than an inner surface of the printing plate mounted on the plate mounting surface. Therefore, by pressing the printing plate outer than the inner surface of the printing plate mounted on the plate mounting surface with the plate fixing member, the possibility of deformation of the printing plate can be eliminated.

According to the invention as recited in the aforementioned Item [3], the plate fixing member is configured to be fixable at an arbitrary position within a range inner than an inner surface of the printing plate mounted on the plate mounting surface. Therefore, the fixing position of the plate fixing member can be adjusted, which enables to perform the attaching and detaching operation of the printing plate in a state in which the plate fixing member is fixed at an arbitrary position.

According to the invention as recited in the aforementioned Item [4], an inner portion of the plate cylinder is formed in a hollow shape. Therefore, the weight of the plate cylinder can be reduced. Further, even when the wall thickness of the plate cylinder is set to be thin, the strength of the plate cylinder is less likely to be impaired.

According to the invention as described in the aforementioned Item [5], the plate cylinder main body is provided with an air ejection hole at a position away from a tip end side by 20 mm to 50 mm, and a surface roughness Ra of the plate cylinder main body is set to 0.025 μm to 0.5 μm. Thus, the plate cylinder main body has an appropriate surface roughness, and the air ejection hole is formed in the tip end side of the plate cylinder main body, which is an insertion side for inserting the printing plate, that is, the air ejection hole is formed at a position where the printing plate can be easily inserted. For this reason, an air layer can be formed between the plate cylinder main body and the printing plate by ejecting air through the air ejection hole, enhancing the slippage of the printing plate to be inserted or removed, which in turn can facilitate the attaching and detaching operation.

According to the invention as recited in the aforementioned Item [6], a plurality of the air ejection holes is formed in a tip end side of the plate cylinder main body along a circumferential direction thereof. Thus, a plurality of air ejection holes are provided on the tip end side of the plate cylinder main body, which is an insertion side of the printing plate. This further enhances the slippage of the printing plate to be inserted or removed by the air ejected from the plurality of positions at the time of attaching and detaching the printing plate, which in turn can facilitate the attaching and detaching operation of the printing plate.

According to invention as recited in the aforementioned Item [7], in a method of attaching and detaching a printing plate with respect to the plate cylinder as recited in the aforementioned Item [5] or [6], attaching and detaching the printing plate with respect to the plate cylinder is performed while electing air through the air ejection hole. Therefore, the air ejected from the air ejection hole is interposed between the outer peripheral surface of the plate cylinder and the inner peripheral surface of the printing plate, which can facilitate the detaching and attaching operation of the printing plate.

EMBODIMENTS FOR CARRYING OUT THE INVENTION

Hereinafter, embodiments of the present invention will be described with reference to the drawings.

Figure 1:
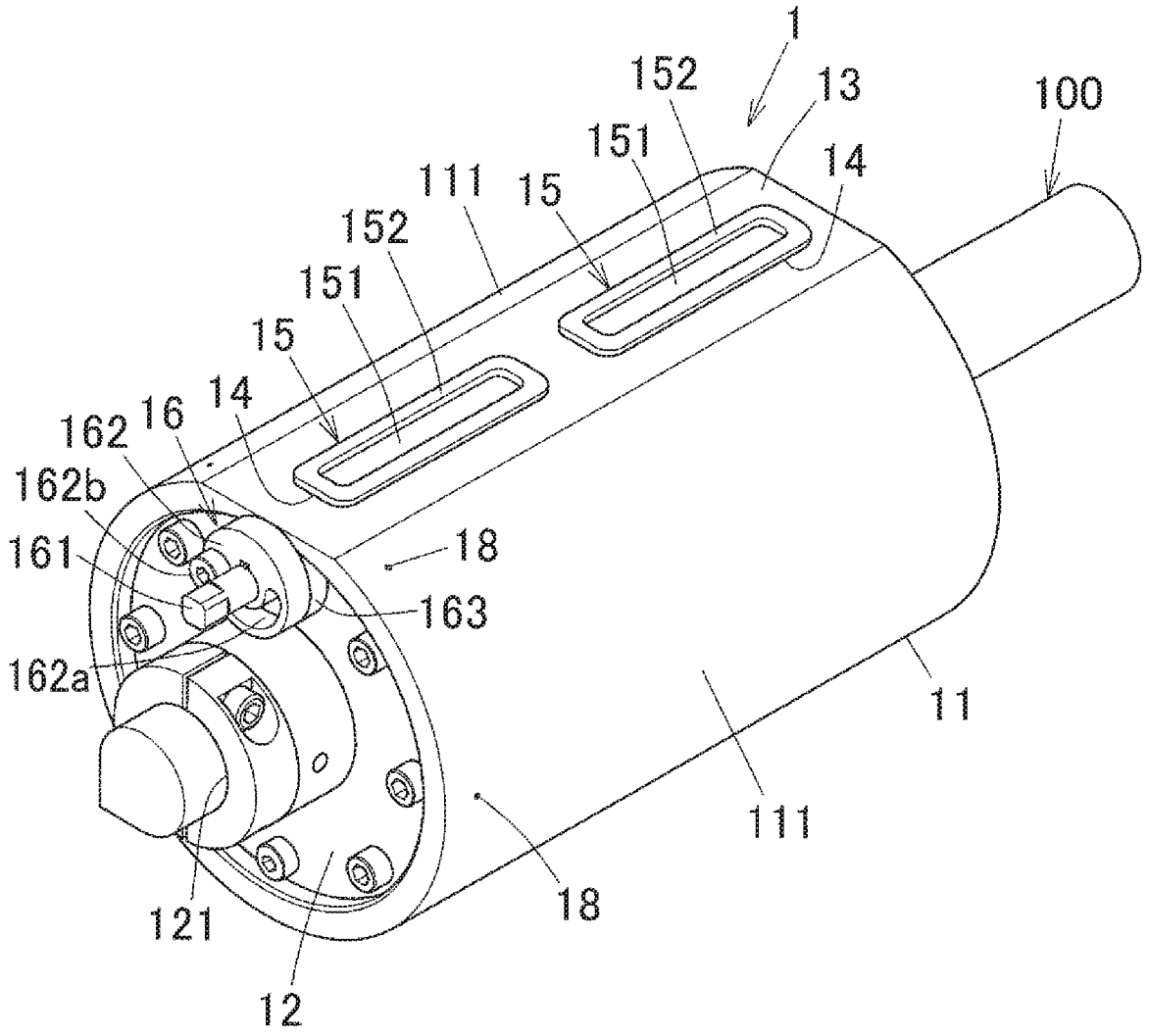
FIG. 1 is an overall perspective view showing a plate cylinder according to the present invention.
Figure 2:
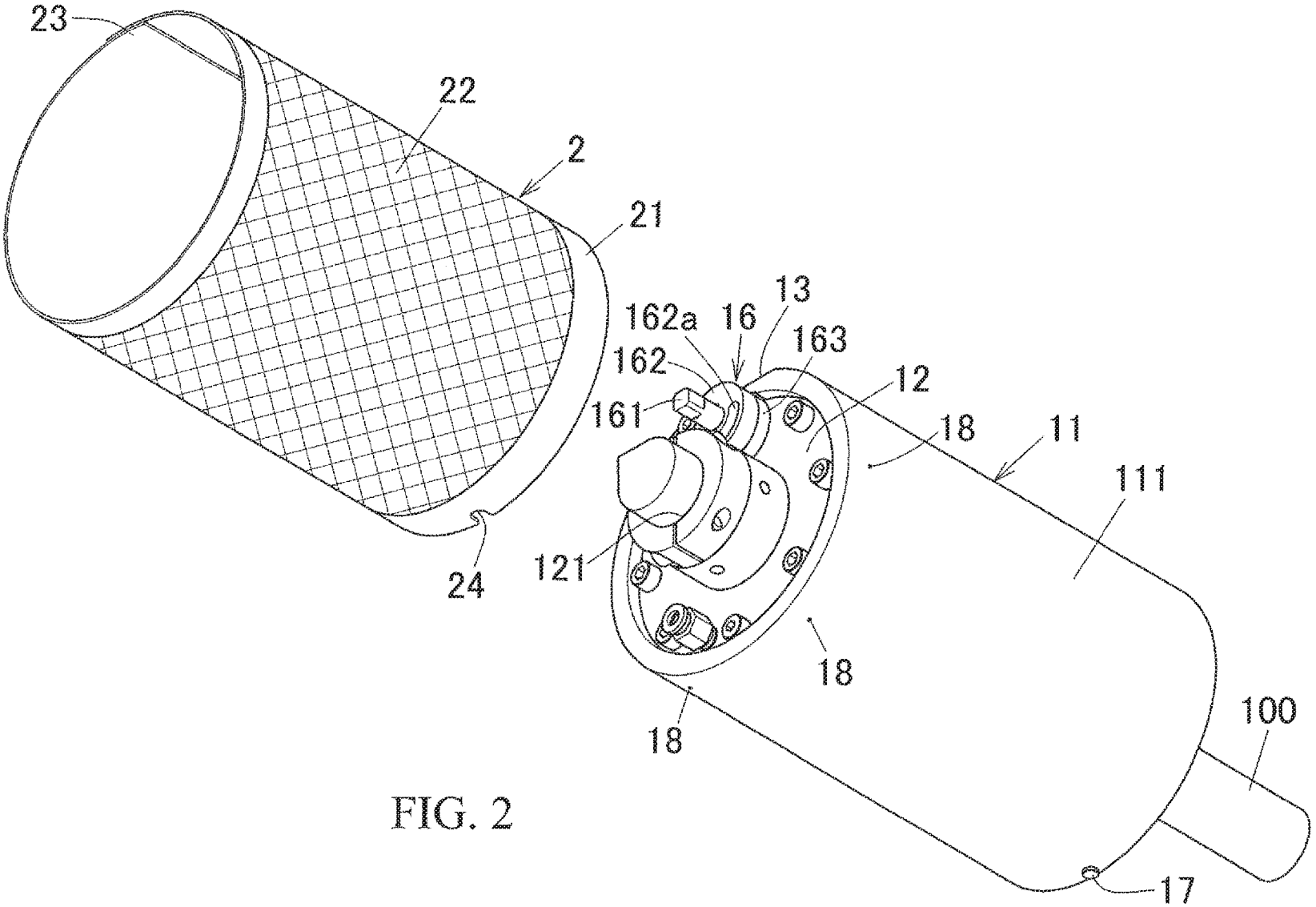
FIG. 2 is an explanatory view for explaining the printing plate according to the present invention and a plate cylinder.
Figure 3:
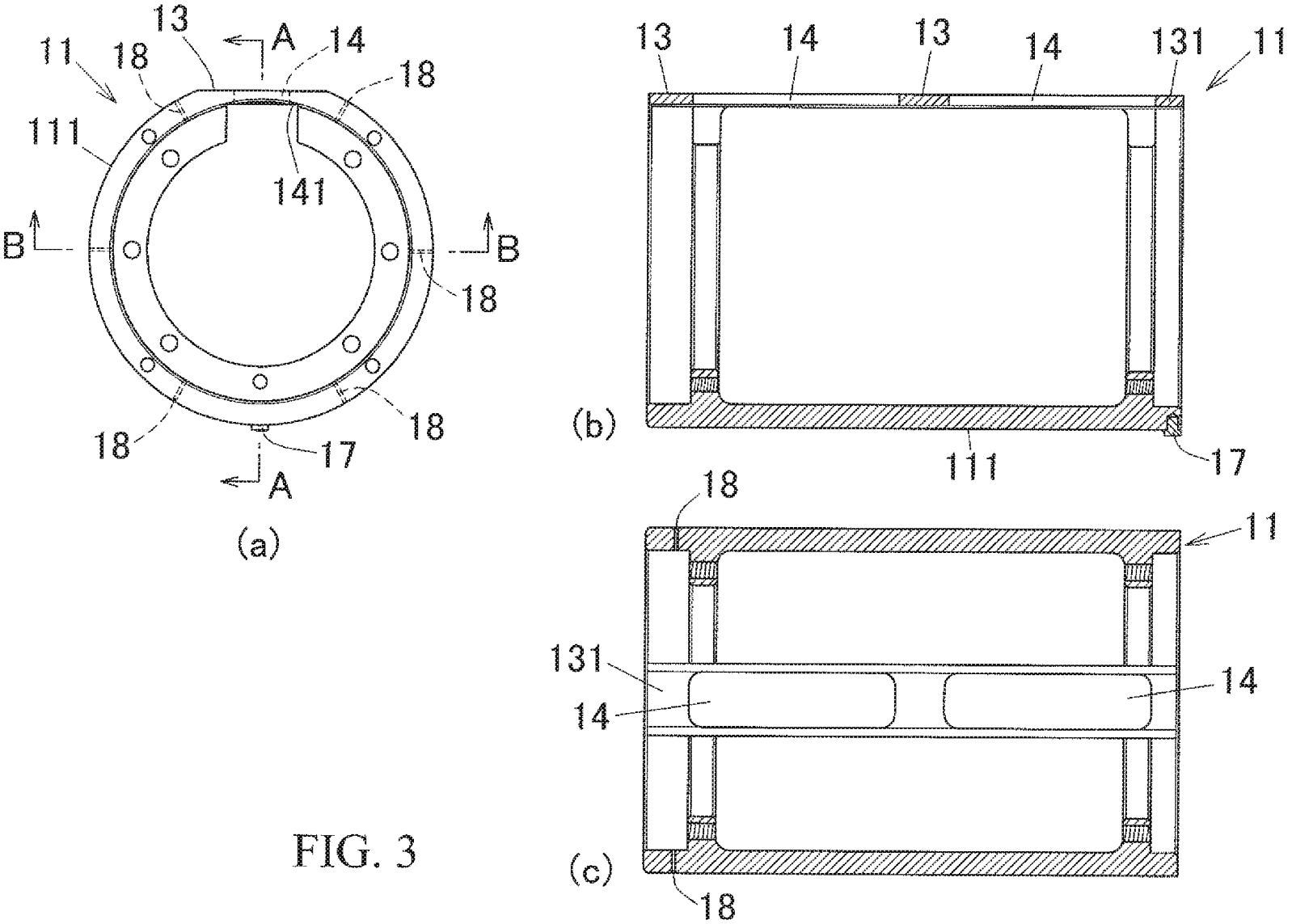
FIG. 3 shows a front view and cross-sectional views for explaining the plate cylinder according to the present invention.
Figure 4:
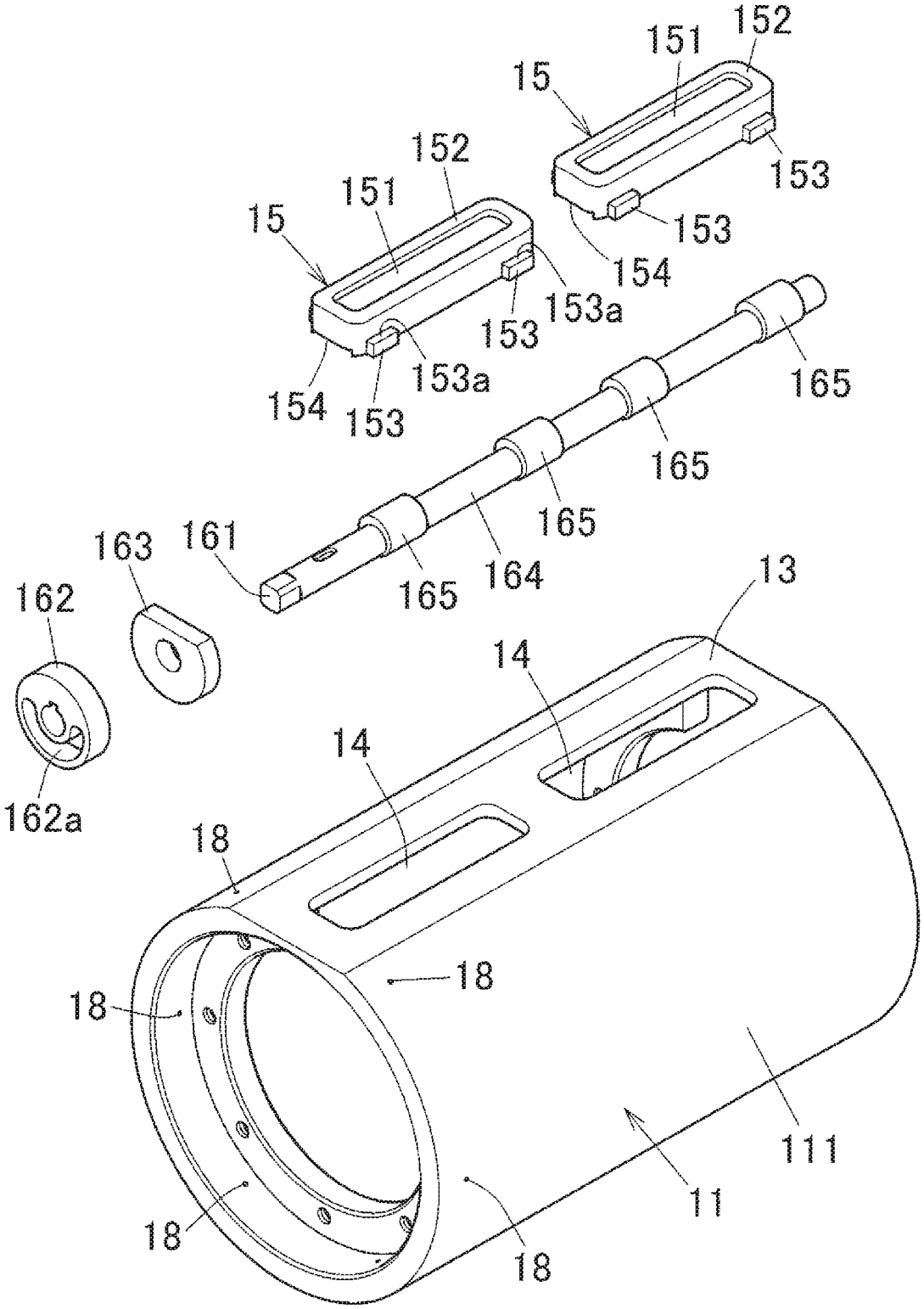
FIG. 4 is an explanatory view for explaining the plate cylinder according to the present invention.
Figure 5:
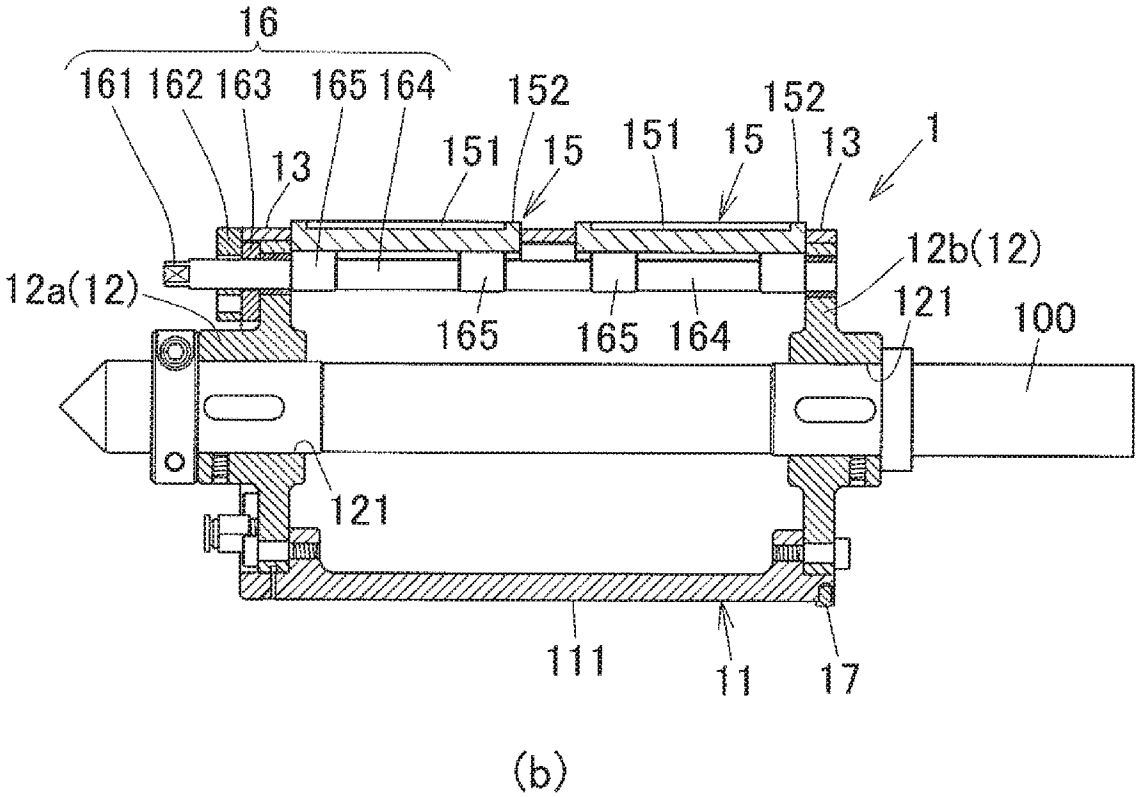
FIG. 5 is a front view and a cross-sectional view for explaining the behavior of the plate fixing member of the plate cylinder according to the present invention.
Figure 5:
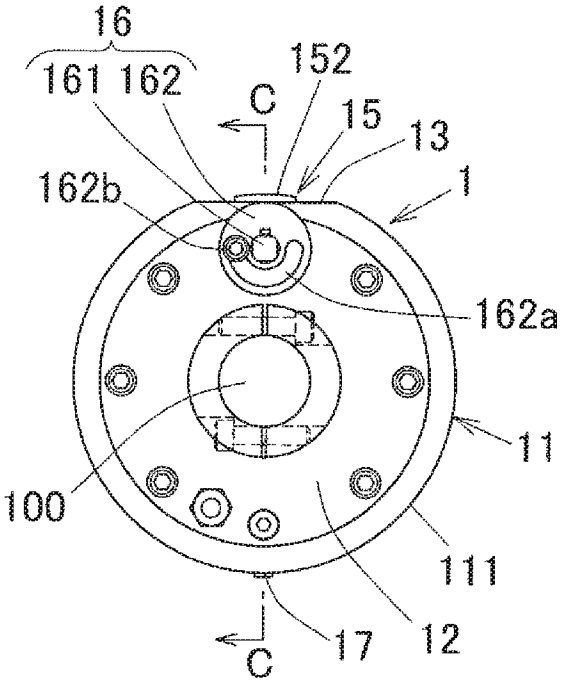
Figure 6:
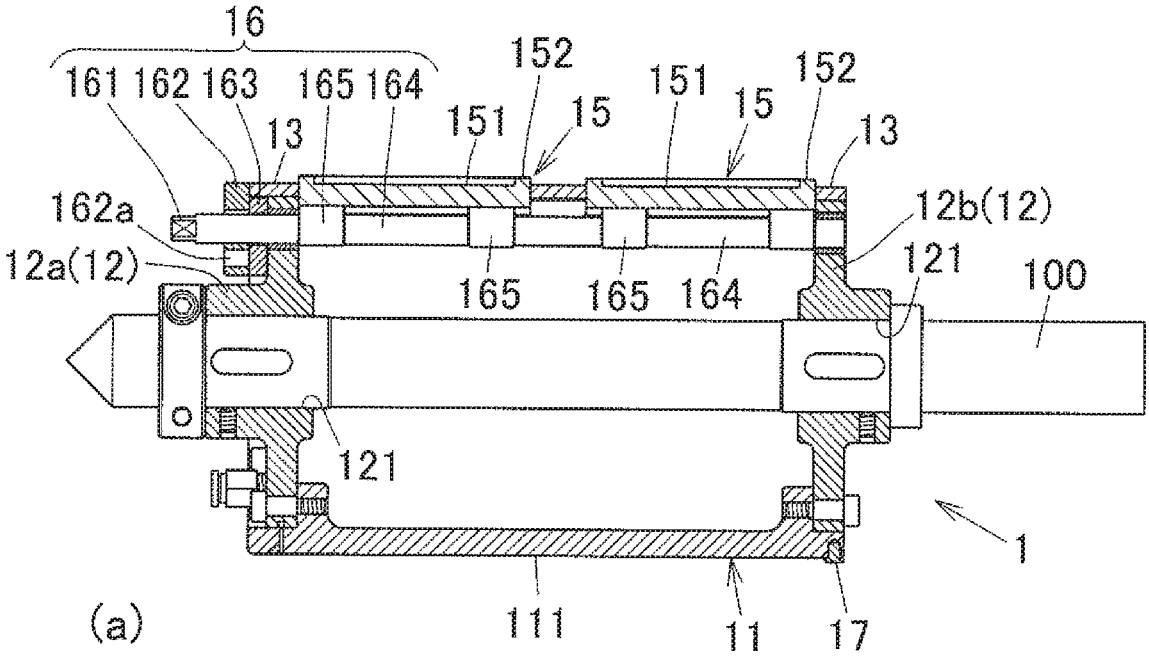
FIG. 6 shows longitudinal cross-sectional views for explaining the behavior of the plate fixing member of the plate cylinder according to the present invention.
Figure 6:
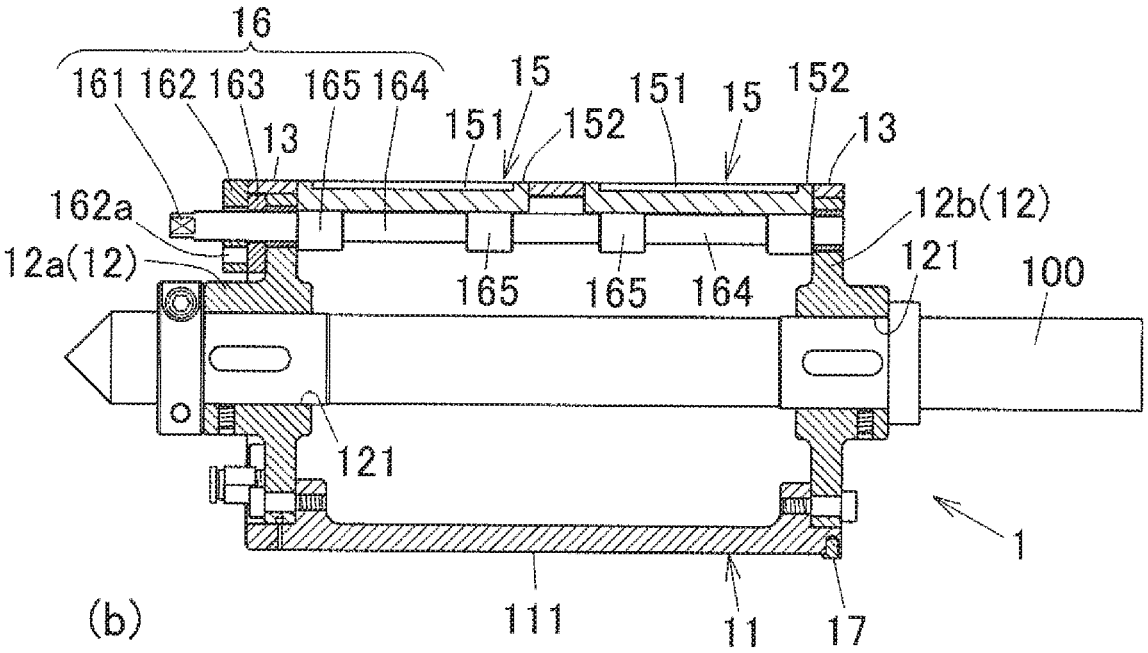
Figure 7:
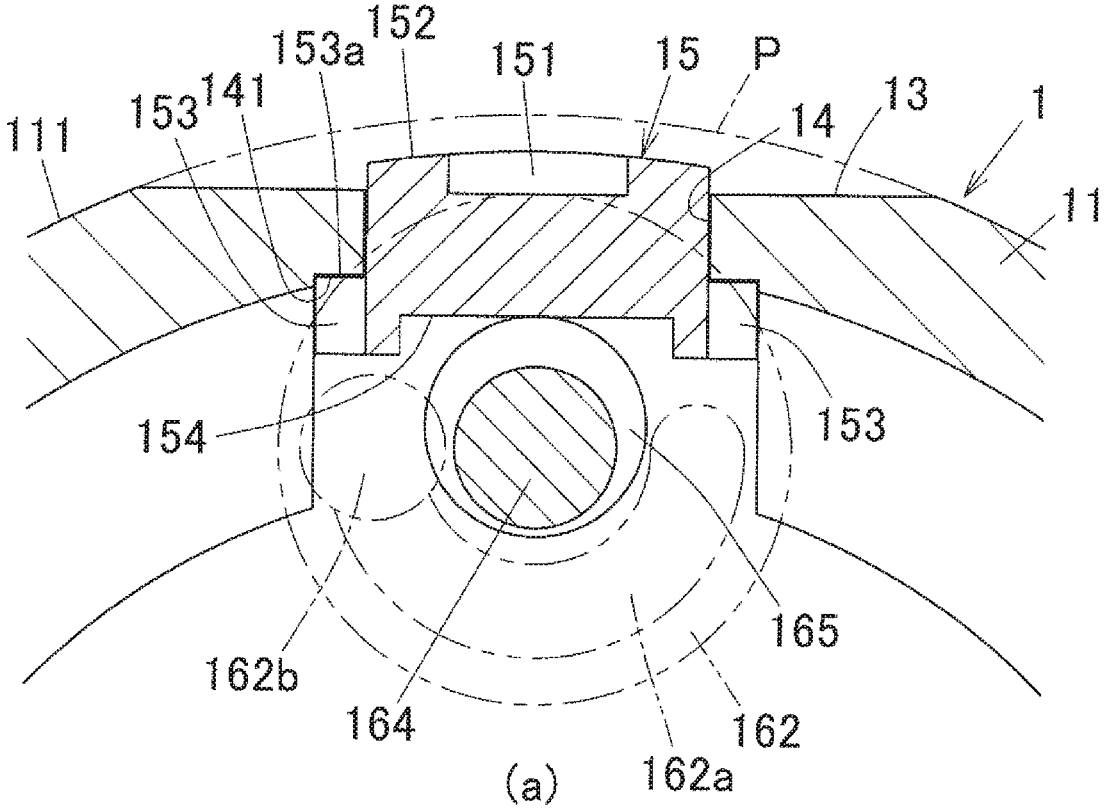
FIG. 7 shows detailed views for explaining the behavior of the plate fixing member of the plate cylinder according to the present invention.
Figure 7:
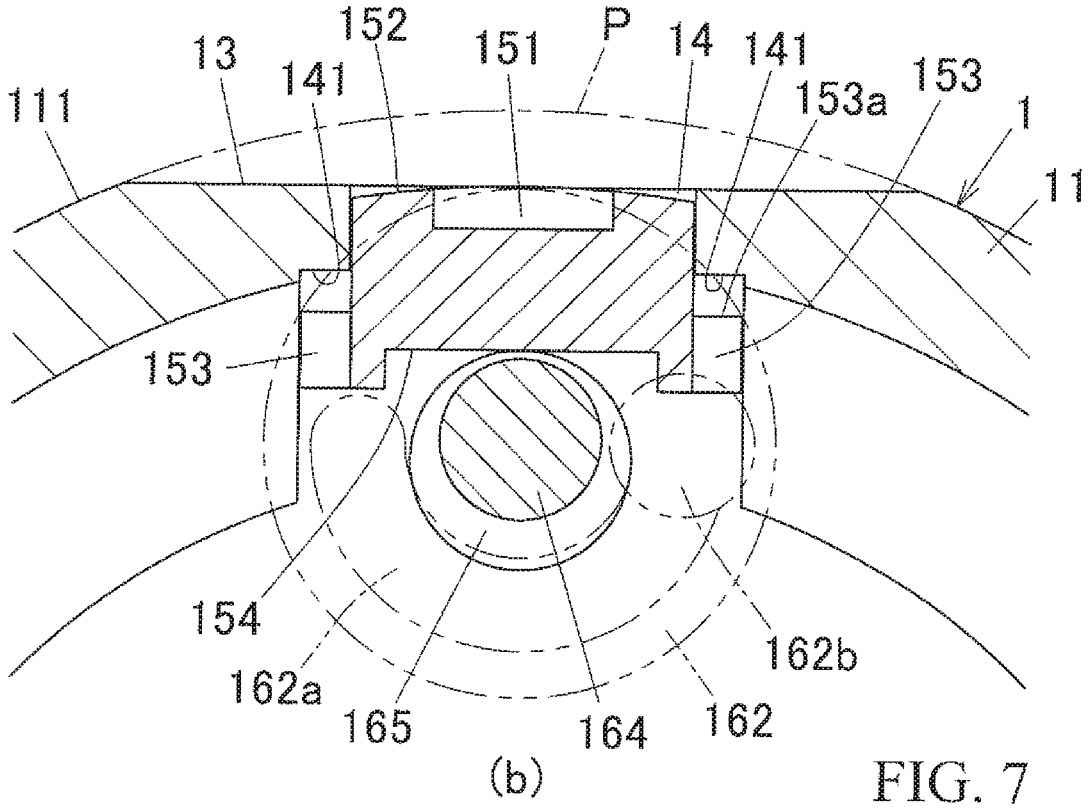

FIG. 1 is an overall perspective view of a plate cylinder 1. FIG. 2 is an explanatory view for explaining the plate cylinder 1 and a printing plate 2. FIG. 3 shows a front view and cross-sectional views for explaining the plate cylinder 1. FIG. 4 is an explanatory view for explaining the plate cylinder 1. FIG. 5 is a front view and a cross-sectional view for explaining the behavior of a plate fixing member 15 of the plate cylinder 1. FIG. 6 shows longitudinal cross-sectional views for explaining the behavior of the plate fixing member 15 of the plate cylinder 1. FIG. 7 shows detailed views for explaining the behavior of the plate fixing member 15 of the plate cylinder 1.

First, with reference to FIGS. 1 to 7, a plate mounting device equipped with a plate cylinder 1 on which a cylindrical printing plate 2 is to be mounted for printing on a metal can will be described.

The plate mounting device is commonly equipped in a printing device used for printing on a print object and an engraving machine used for engraving a printing pattern on a printing plate 2 used for a printing device.

As the printing plate 2 to be mounted on the plate cylinder 1, a cylindrically formed printing plate 2, particularly a printing plate 2 having a small diameter, is used.

The substrate to be printed is a metal can for beverages. In particular, a bottomed cylindrical metal can for beverages formed by subjecting an aluminum or aluminum alloy flat plate to drawing and ironing (DI) is suitably used for the substrate to be printed.

The plate mounting device includes a plate driving shaft 100 provided so as to protrude forward from the machine frame of the printing device and a plate cylinder 1 fixed to the outer peripheral surface of the plate driving shaft 100.

The plate driving shaft 100 is rotatably supported, on the base end portion side, by a machine frame of the printing device and is rotated at a predetermined speed in a predetermined direction by a known driving means.

Hereinafter, the left side of the plate cylinder 1 in the axial direction of the plate driving shaft 100 shown in FIG. 1 is defined as a front or a tip end, while the right side in the axial direction of the plate driving shaft 100 is defined as a rear or a rear end. As viewed from the front, the left and right are defined as left and right, respectively, and the top and bottom are defined as top and bottom, respectively.

The plate cylinder 1 is fitted on the plate driving shaft 100 from the tip end portion side thereof and fixed to its outer peripheral surface.

The plate cylinder 1 is formed in a cylindrical shape, and an insertion hole 121 through which the plate driving shaft 100 is inserted is provided at the center of the cylindrical shape.

On the outer periphery of the plate cylinder 1, a cylindrical plate mounting surface 111 concentric with the plate driving shaft 100 is formed, and a cylindrically formed printing plate 2 is to be detachably attached to the plate mounting surface 111.

The inside of the plate cylinder 1 is removed to form a hollow space for the purpose of weight reduction with the exception of the portion forming the insertion hole 121. The plate cylinder 1 is equipped with a plate cylinder main body 11 in which a plate mounting surface 111 is formed on the outer periphery and a lid portion 12 covering the front of the plate cylinder 1.

The plate cylinder 1 is fixed to the plate driving shaft 100 in a state in which the plate driving shaft 100 is fitted in the insertion hole 121 and rotates integrally with the plate driving shaft 100.

For the plate mounting surface 111, for the purpose of securing the fixing force by the frictional resistance with the inner surface of the mounted printing plate 2, it is preferable that the surface roughness of the plate mounting surface 111 maintain a static friction of about Ra 1 μm or less.

Further, considering that the surface roughness is kept small and the surface is not easily scratched, it is preferable to subject the plate mounting surface 111 to hard chrome coating (plating).

It is preferable that the surface roughness of the plate mounting surface 111 be as small as possible because the frictional resistance at the time of mounting the printing plate 2 becomes large when the surface roughness value is large. However, when it is too small, the processing cost of the plate cylinder 1 increases. Therefore, it is preferable that the surface roughness be set to Ra 0.025 μm to 0.5 μm, more preferably Ra 0.05 to 0.2 μm.

The plate cylinder main body 11 is equipped with air ejection holes 18 at positions away from the tip end side by 20 mm to 50 mm. The surface roughness Ra is set to 0.025 μm to 0.5 μm. Thus, the plate cylinder main body 11 has an appropriate surface roughness. Further, the air ejection holes 18 are provided on the tip end side of the plate cylinder main body 11, which is the side from which the printing plate 2 is inserted. That is, the air ejection holes 18 are formed at the positions where the printing plate 2 can be easily inserted. Therefore, by ejecting air from the air ejection holes 18, an air layer can be formed between the plate cylinder main body 11 and the printing plate 2, enhancing the slippage of the printing plate 2 to be inserted or removed, which in turn can facilitate the attaching and detaching operation of the printing plate 2.

In the plate cylinder 1, a flat portion 13 forming a flat surface formed by removing a part of the cylindrical portion is served as a plate fixing member mounting surface (see FIG. 1). A portion of the outer periphery of the cylindrical portion except for the flat portion 13 is served as the plate mounting surface 111 on which the printing plate 2 is to be mounted.

In this embodiment, since the thickness dimension of the flat portion 13 is formed by cutting a part of the outer peripheral surface of the plate cylinder main body 11, the thickness dimension of the flat portion 13 is set to be smaller than the thickness dimension of the plate cylinder 1 at the part where the plate mounting surface 111 is provided.

The flat portion 13 is configured to be positioned radially inward of the cylindrical surface including the plate mounting surface 111. As detailed later, in order to closely fix the printing plate 2 to the plate mounting surface 111, the flat portion 13 is provided with a substantially rectangular plate fixing member 15 configured to be movable radially inward and outward on the outer peripheral surface of the plate cylinder 1.

The outer diameter of the plate mounting surface 111 is set to a dimension approximately equal to the inner diameter of the printing plate 2, but since the plate cylinder 1 has the flat portion 13, the total peripheral length of the plate mounting surface 111 and the flat portion 13 becomes shorter than the circumferential length of the cylindrical surface formed by the plate mounting surface 111 of the plate cylinder 1.

The circumferential length of the inner peripheral surface of the printing plate 2 is set to be slightly larger than the total circumferential length of the plate mounting surface 111 and the flat portion 13 of the plate cylinder 1 and slightly smaller than the circumferential length of the cylindrical surface formed by the plate mounting surface 111 of the plate cylinder 1.

In the flat portion 13 of the plate cylinder 1, hole portions 14 each formed in a substantially rectangular shape having the same shape as the plate fixing member 15 are formed side by side in the axial direction of the plate cylinder 1.

On the lower side of the rear end portion of the plate cylinder 1, a positioning protrusion 17 for positioning the printing plate 2 in the circumferential direction is provided.

The positioning protrusion 17, for example, slightly protrudes radially outward of the plate cylinder 1, and is formed as a protrusion having a substantially circular shape in planar view.

The positioning protrusion 17 is configured such that, when the printing plate 2 is fitted from the tip end side of the plate cylinder 1, a positioning notch 24 provided on the rear end portion side of the printing plate 2 is engaged with the positioning protrusion 17 of the plate cylinder 1.

By providing the positioning protrusion 17, the printing plate 2 can be accurately and easily attached to a predetermined position of the plate cylinder 1.

The printing plate 2 to be mounted on the plate cylinder 1 is provided with a plate body 21 formed in a cylindrical shape by an elastic material and a plate portion 22 formed on a part of the outer periphery of the plate body 21.

The plate body 21 is formed into a printing plate 2 by rolling an elastic material sheet into a cylindrical shape and joining both overlapped end portions together.

As a method of joining the joint portion 23, joining by welding is most preferable, but the method is not particularly limited as long as an adhesion method not causing easy detachment is used.

The plate portion 22 is provided at a predetermined position on the outer peripheral surface of the plate body 21 except for the joint portion 23, and is formed on the outer surface portion of the plate body 21 which comes into close contact with the plate mounting surface 111 when the printing plate 2 is mounted on the plate cylinder 1.

In this example, only one plate portion 22 is provided on the outer peripheral surface of the plate body 21.

As the elastic material sheet, an elastic material sheet of a rectangular shape made of, e.g., an appropriate magnetic or non-magnetic metal is adopted. For example, a commercially available tin plate (Fe) can be adopted. The thickness of the sheet may be enough to have a degree that it can form a cylindrical shape and maintain the cylindrical shape by elasticity. In this example, it is about 0.26 mm.

On one surface of the plate body 21, a resin layer to be served as the plate portion 22 is formed. For the resin layer, for example, a polyvinyl alcohol based resin, a vinyl ester based resin, a polyamide based resin, etc., can be adopted. A resin having a Shore D hardness of about D20 to 80 after curing is suitably adapted.

For example, when a UV curable resin (ultraviolet curable resin) used for a normal offset printing is adopted, it is not necessary to perform a complicated cleaning operation with a solvent or high pressure steam required for other curable resins, and the cleaning operation can be easily performed generally with water washing.

The thickness of the resin layer may be any thickness as long as it is a thickness required for the printing plate portion 22. In this example, a layer having a thickness of 0.4 mm to 0.6 mm is bonded to one surface of an elastic material sheet.

The cylindrically formed printing plate 2 is fitted on the plate cylinder 1 from the tip end side and mounted on the plate mounting surface 111 which is the outer peripheral surface of the plate cylinder 1.

The plate portion 22 of the printing plate 2 is formed on the outer surface portion of the plate body 21 which comes into close contact with the plate mounting surface 111 when the printing plate 2 is mounted on the plate cylinder 1.

The axial length of the formed printing plate 2 is set to be shorter than the axial length of the plate cylinder 1.

In the printing plate 2, a positioning notch 24 is formed at one longitudinal end portion, specifically, a portion corresponding to the lower end portion on the rear end side when attached to the plate mounting surface 111 of the plate cylinder 1.

The positioning notch 24 is configured by a notch extending in the axial direction of the printing plate 2 so as to be engaged with the positioning protrusion 17 of the plate cylinder 1.

The deep end portion (concave portion) of the positioning notch 24 is formed in a circular arc shape having a curvature that coincides with the outer peripheral shape of the circumferential direction positioning protrusion 17.

In the positioning notch 24, for example, when the printing plate 2 is mounted to the rear end side of the plate cylinder 1, the end portion of the positioning notch 24 comes into contact with the outer peripheral surface of the positioning protrusion 17. This enables the positioning of the printing plate 2 in the circumferential direction and the axial direction of the plate cylinder 1.

The printing plate 2 positioned with respect to the plate cylinder 1 in the circumferential direction and in the axial direction of the plate cylinder 1 is fixed in position by the plate fixing member 15 of the plate cylinder 1 in order to prevent displacement of the printing plate 2 caused by the rotating operation, etc., of the plate cylinder 1.

The hole portions 14 formed in the flat portion 13 of the plate cylinder 1 each are a hole penetrating the flat portion 13, and, for example, each formed to have a rectangular shape in planar view.

A plurality of hole portions 14 are formed side by side in the axial direction of the plate cylinder 1 and arranged in a separated state.

In this example, two hole portions 14 are formed side by side in a line in the axial direction of the plate cylinder 1.

As described above, when the thickness dimension of the flat portion 13 is set to be thinner than the other thickness dimensions of the plate cylinder 1, it is more important to secure the strength of the flat portion 13 in the vicinity of where the hole portions 14 are provided.

As described above, a plurality of hole portions 14 are arranged in a separated state. With this, a connection portion is formed between the adjacent hole portions 14, that is, a portion continuous with the flat portion 13 is formed. As a result, this portion can secure the strength of the portion in the vicinity of where the hole portions 14 are provided.

The hole portion 14 is set approximately equal to the dimension of the plate fixing member 15. The hole portion 14 is configured such that the plate fixing member 15 is fitted so as to be movable in the radial direction of the plate cylinder 1 in the hole portion 14.

The length dimension and the width dimension of each hole portion 14 are slightly larger than the respective dimensions of the plate fixing member 15, and set to the dimensions that the plate fixing member 15 fitted in the hole portion 14 can move up and down freely in the hole portion 14.

The hole portion 14 is provided with an engaging groove 141 extending in the axial direction on the rear side, that is, the inner surface of the plate cylinder 1.

The engaging groove 141 is provided as a removal prevention mechanism when the plate fixing member 15 is moved radially outward of the plate cylinder 1, and is configured such that an engaging stepped portion 153 of a plate fixing member 15 to be described later is engaged with the engaging groove 141.

The plate fixing member 15, as shown in the figures, is formed in an approximately rectangular shape elongated in the axial direction of the plate cylinder 1, and a plurality of the plate fixing members 15 is provided in the flat portion 13 concentrically with the plate cylinder 1.

In this example, two plate fixing members 15 are provided side by side in a line in the axial direction with a distance.

The plate fixing member 15 is configured such that it is fitted in the hole portion 14 from the inner side of the plate cylinder 1 and the radially outward end face of the plate fixing member 15 comes into contact with the inner periphery surface of the printing plate 2 when the plate fixing member is moved radially outward of the plate cylinder 1.

Hereinafter, the radially outward end face of the plate fixing member 15 which comes into contact with the inner peripheral surface of the printing plate 2 will be referred to as a plate contact surface 152.

The plate contact surface 152 is formed with a cylindrical surface having the same curvature or the same degree of curvature as the plate mounting surface 111, and configured such that the plate contact surface 152 does not go beyond the position P of the cylindrical surface formed by the plate mounting surface 111 (the broken line portion as shown in FIG. 7) when most moved radially outward of the plate cylinder 1.

The plate contact surface 152 is preferably formed with a cylindrical surface of the same curvature or the same degree of curvature as the plate mounting surface 111 since there is no possibility of deformation of the printing plate 2 when, for example, the plate contact surface 152 comes into contact with the inner peripheral surface of the printing plate 2. However, the plate contact surface may be formed into a plane parallel to the flat portion 13.

The inner side of the plate fixing member 15 is, for example, hollowed out into a hollow shape for weight reduction. A dent 151 is formed at the center of the plate contact surface 152 of the plate fixing member 15, further contributing to the weight reduction.

The inner portion of the plate cylinder 1 is formed in a hollow shape. Therefore, it is possible to reduce the weight of the plate cylinder 1, and even when the thickness of the plate cylinder 1 is set to be thin, the strength of the plate cylinder 1 will not be impaired.

The plate fixing member 15 is provided with engaging stepped portions 153 formed so as to protrude outward at the lower portions of both longitudinal side surfaces.

The engaging stepped portion 153 is formed to prevent the plate fixing member 15 from being pulled out of the plate cylinder 1 radially outward when the plate fixing member 15 is moved in the hole portion 14. The engaging stepped portion 153 is configured such that the stepped portion upper face 153*a* of the engaging stepped portion 153 is engaged with an engaging groove 141 formed on the inner surface of the flat surface of the plate cylinder 1 to serve as a stopper portion of the plate fixing member 15.

In this example, the engaging stepped portion 153 is formed in a rectangular shape at portions of the lower portion of both longitudinal side surfaces of the plate fixing member 15, and front side and rear side portions. The respective engaging stepped portions 153 are integrally provided.

The plate fixing member 15 is provided with a cam contact groove 154 which is a groove of a U-shaped cross-sectional shape formed by cutting out a part of the bottom portion of the lateral side surface except for the longitudinal side surface.

The plate fixing member 15 is configured to push a part of the printing plate 2 mounted on the plate cylinder 1 from the radially inner side to the radially outer side within the range of inner than the cylindrical surface formed by the outer surface including the plate portion 22 of the printing plate 2 and expand its diameter.

On the front side of the lid portion 12, an operation portion 16 for adjusting the protrusion amount of the plate fixing member 15 is provided.

The operation portion 16 equipped with a lock portion 162 provided on the front of the lid portion 12, a spacer 163 provided between the lock portion 162 and the lid portion 12, and a rotating shaft 164 inserted in a circular hole formed at the center portion of the lock portion 162 and the spacer 163 and attached in a fixed manner.

The lock portion 162 is made of a plate member having an appropriate thickness and provided with an operation permission hole 162*a* which is a hole penetrating in the thickness direction.

When viewing the lock portion 162 from the front side, the operation permission hole 162*a* is provided on the outer periphery of the rotating shaft 164 and formed as an elongated hole along a part of the outer peripheral circle of the lock portion 162.

In this example, the operation permission hole 162*a* is set to be positioned in a lower position (see FIG. 6) when the plate fixing member 15 is set to the lowest position.

In the operation permission hole 162*a*, a fixing member 162*b* composed of a member such as a lock bolt and a cap screw having one end fixed to the lid portion 12 is loosely fitted. The fixing member is provided so that the other end of the fixing member 162*b* protrudes forward of the lock portion 162.

The lock portion 162 is restricted in its rotation by the operation permission hole 162*a* and the fixing member 162*b*. In this example, the lock portion is configured to be rotatable within the range of about 180 degrees.

The lock portion 162 is configured to rotate within the range of the operation permission hole 162*a* in accordance with the rotating operation of the rotating shaft 164. The lid portion 12 and the spacer 163 are configured such that the rotating shaft 164 is inserted via a bearing member, etc., and that the lid portion 12 and the spacer 163 do not move regardless of the rotating operation of the rotating shaft 164.

The spacer 163 is formed in, for example, a shape in which a part of the outer periphery of a perfect circle is cut out in a front view, and is fixedly attached to the lid portion 12.

Under the plate fixing member 15, the rotating shaft 164 extending in the axial direction of the plate cylinder 1 and configured to be rotatable is provided. The plate fixing member 15 is configured to be movable radially inward and outward of the plate cylinder 1 in accordance with the rotating operation of the rotating shaft 164.

The rotating shaft 164 is configured such that the rotating shaft 164 is provided so as to extend in the axial direction of the plate cylinder 1 and that the rear end side of the rotating shaft 164 is rotatably supported on the rear end side of the plate cylinder 1 and the tip end side of the rotating shaft 164 protrudes from the lid portion 12 of the plate cylinder 1.

The tip end portion of the rotating shaft 164 protruding forward of the lid portion 12 is gripped with hand, etc., and serves as a gripping portion 161 for rotatably operating the rotating shaft 164.

Although the illustrated gripping portion 161 is a rectangular shaft extending in the axial direction of the plate cylinder 1, it may be, for example, a shaft formed in a cylindrical shape. The shape is not particularly limited as long as it does not interfere with the operation of the operation portion 16.

The rotating shaft 164 is provided with a plurality of eccentric cams 165 fixed on the outer peripheral surface at predetermined intervals in the axial direction.

In this example, the eccentric cam 165 is a cylindrical member formed in a perfect circular shape and having a moderate thickness along the axial direction of the plate cylinder 1, and is provided at a position slightly eccentrically-located from the center position of the rotating shaft 164.

The eccentric cam 165 is arranged under the cam contact groove 154 on the lower side of the plate fixing member 15 and is arranged on the rotating shaft 164 so that a part of the eccentric cam 165, in this example the upper end of the eccentric cam 165, is in contact with the cam contact portion of the plate fixing member 15.

The eccentric cam 165 is configured so that the rotating shaft 164 is provided at a position eccentrically-located from the center and the position of the upper end varies according to the rotation of the rotating shaft 164, which contributes to the movement operation of the plate fixing member 15 in the radially inward and outward directions of the plate cylinder 1.

The plate fixing member 15 is set so that the outer peripheral surface (plate contact surface 152) can move within the range inner than the inner surface of the printing plate 2 mounted on the plate mounting surface 111 along with the rotating operation of the rotating shaft 164 and can be fixed at a predetermined position within the range.

The plate fixing member 15 is configured in a manner as to be movable radially outward of the plate cylinder 1 inside the plate cylinder 1.

As described above, the circumferential length of the inner peripheral surface of the printing plate 2 is set to be slightly larger than the total circumferential length of the plate mounting surface 111 and the flat portion 13 and slightly smaller than the circumferential length of the cylindrical surface formed by the plate mounting surface 111 of the plate cylinder 1. This facilitates the insertion of the printing plate 2 with respect to the plate cylinder 1 and can avoid the situation in which the part of the printing plate 2 pressed by the plate fixing member 15 protrudes radially outward of the other part of the printing plate 2.

For example, as shown in FIG. 6 (*a*), when the rotating shaft 164 is rotatably operated so that the upper end of the eccentric cam 165 is positioned at the highest position, the cam contact groove 154 is pushed up by the upper end of the eccentric cam 165, raising the position of the fixing member 15, which moves the plate contact surface 152 of the plate fixing member 15 so as to protrude outward of the flat portion 13.

Further, as shown in FIG. 6 (*b*), when the rotating shaft 164 is rotated such that the upper end of the eccentric cam 165 is positioned at the lowest position, the upper end of the eccentric cam 165 descends, moving the cam contact groove 154 in contact with the eccentric cam 165 downward. Thus, the position of the plate fixing member 15 descends so that the plate contact surface 152 of the plate fixing member 15 moves so as to be approximately parallel (substantially flush) with the surface of the flat portion 13.

The plate fixing member 15 is configured such that its outer peripheral surface is movable within the range inner than the inner surface of the printing plate 2 mounted on the plate mounting surface 111. Therefore, the possibility of deformation of the printing plate 2 due to the pushing of the printing plate 2 by the plate fixing member 15 outer than the inner surface of the printing plate 2 mounted on the plate mounting surface 111 can be eliminated.

The plate fixing member 15 is configured so as to be fixed at an arbitrary position within the range inner than the inner surface of the printing plate 2 mounted on the plate mounting surface 111. Therefore, the fixing position of the plate fixing member 15 can be adjusted, so that detaching and attaching the printing plate 2 can be performed in a state in which the plate fixing member 15 is fixed at an arbitrarily position.

In the plate cylinder 1, air ejection holes 18 are formed at a plurality of locations on the outer peripheral surface on the tip end side.

The air ejection hole 18, in this example, is formed to have a diameter of 1.2 mm, and a total of six air ejection holes 18 are equally arranged in the circumferential direction on the tip end portion side of the plate cylinder 1.

Each air ejection hole 18 is configured such that air supplied from an air supply means not illustrated and provided inside the plate cylinder 1 is ejected toward the outside.

In this example, the air to be ejected from the air ejection hole 18 is ejected from the air ejection hole 18 at an air pressure of 4 kgf/cm$^2$ to 5 kgf/cm$^2$, and supplied and stopped by opening and closing the valve of the air supply means manually at the time of attaching and detaching the printing plate 2.

If the number of provided air ejection holes 18 is too small or the air ejection holes 18 are not uniformly arranged, the air layer formed between the plate cylinder 1 and the printing plate 2 cannot become uniform, making it difficult to attach and detach the printing plate 2, and therefore it is not preferable. If the number of air ejection holes 18 is excessive, processing becomes complicated, resulting in a high cost, and therefore it is not preferable.

For this reason, the air ejection hole 18 is preferably provided at a position away from the tip end portion by 20 mm to 50 mm, and more preferably provided at a position away from the front edge portion by 30 mm to 40 mm.

The size and shape of the air ejection hole 18 are set such that air is uniformly ejected between the plate cylinder 1 and the printing plate 2 and an air layer is uniformly formed.

If the position where the air ejection hole 18 is provided is too close to the tip end portion of the plate cylinder 1, air will leak from the front edge portion of the plate cylinder 1 with the printing plate 2 mounted on the plate cylinder 1. As a result, an air layer cannot be properly formed between the plate cylinder 1 and the printing plate 2, and therefore it is not preferable.

On the other hand, if the position where the air ejection hole 18 is provided is too far from the tip end portion of the plate cylinder 1, when inserting the printing plate 2 to mount on the plate cylinder 1, it becomes difficult to insert the printing plate 2 to the position where the air ejection hole 18 is provided, and therefore it is not preferable.

Since a plurality of air ejection holes 18 are provided in the circumferential direction on the tip end side of the place cylinder main body 11, a plurality of air ejection holes 18 are performed on the tip end side of the place cylinder main body 11 which is an insertion side of the printing plate 2. Accordingly, when attaching and detaching the printing plate 2, the air ejected from a plurality of portions facilitates the slippage of the printing plate to be inserted or removed, resulting an easy attaching and detaching operation of the printing plate 2.

The procedure for attaching and detaching the printing plate 2 to and from the plate cylinder 1 is as follows.

Before mounting the cylindrically formed printing plate 2 on the plate cylinder 1 from the tip end side of the place cylinder 1, the valve of the air supply means is opened. As a result, from the air ejection holes provided on the tip end side of the place cylinder 1, air will be ejected at a pressure of, for example, 4 kgf/cm$^2$ to 5 kgf/cm$^2$.

In a state in which the air is ejected from the air ejection holes 18, the printing plate 2 is inserted from the tip end side of the place cylinder 1.

At this time, the air ejected from the air ejection holes 18 flows into a slight gap between the plate cylinder 1 and the printing plate 2. Thus, an air layer is formed therebetween.

Since an air layer is formed between the plate cylinder 1 and the printing plate 2, the attaching and detaching operation of the printing plate 2 can be easily performed.

Until the printing plate 2 is completely inserted to the rear end side of the plate cylinder 1, the air layer is uniformly formed between the plate cylinder 1 and the printing plate 2.

When the printing plate 2 is completely inserted to the rear end side of the plate cylinder 1, the valve of the air supply means is closed to stop the supply of air.

When removing the printing plate 2 from the plate cylinder 1, before the removal, the valve of the air supply means is opened so that the air is ejected from the air ejection holes 18.

In the same manner as in the case of inserting the printing plate 2, an air layer is uniformly formed between the plate cylinder 1 and the printing plate 2 also at the time of removal. Thus, the removal operation of the printing plate 2 can be easily performed.

After the printing plate 2 is completely removed from the plate cylinder 1, the valve of the air supply means is closed to stop supplying air.

In the aforementioned description, the hole portion 14 is described as a hole penetrating the flat portion 13, but the invention is not limited to this. The hole portion 14 may be a portion in which a recess not penetrating the flat portion 13 is formed as long as at least the plate fixing member 15 can move radially inward and outward in the hole portion 14.

When attaching and detaching the printing plate 2 to and from the plate cylinder 1 as described above, according to the method of attaching and detaching the printing plate 2 while ejecting air from the air ejection holes 18, the printing plate 2 can be easily attached and detached by the air ejected from the air ejection holes 18 and interposed between the outer peripheral surface of the plate cylinder 1 and the inner peripheral surface of the printing plate 2.

According to the plate cylinder 1, a plate cylinder 1 attached to a rotationally driven plate driving shaft 100 and configured to mount a cylindrical printing plate 2 from a tip end side, includes a plate cylinder main body 11 having a plate mounting surface 111 on which the printing plate 2 is to be mounted, a flat portion 13 formed into a flat surface positioned radially inward of the plate mounting surface 111, a plurality of hole portions 14 formed in the flat portion 13 side by side in an axially separated state, and a plurality of plate fixing members 15 configured to closely fix the printing plate 2 to the plate mounting surface 111. The plate fixing member 15 is fitted in the hole portion 14 so as to be movable radially inward and outward of the plate cylinder 1. Therefore, with the configuration in which the plurality of hole portions 14 are arranged in a separated state, a connection portion is provided between the adjacent hole portions 14, which can enhance the strength of the flat portion 13 of the plate cylinder 1 and can easily fix the printing plate 2 to the plate mounting surface 111.

The above-described embodiments are merely examples of the present invention, and it goes without saying that specific configurations, etc., can be appropriately modified and designed within the range that exerts the functions and effects of the present invention.

The present application claims priority to Japanese Patent Application No. 2015-60594 filed on Mar. 24, 2015, the entire disclosure of which is incorporated herein by reference in its entirety.

It should be understood that the terms and expressions used herein are used for explanation and have no intention to be used to construe in a limited manner, do not eliminate any equivalents of features shown and mentioned herein, and allow various modifications falling within the claimed scope of the present invention.

INDUSTRIAL APPLICABILITY

The present invention can be used as a plate cylinder for mounting a printing plate for printing a metallic can.

Description of Reference Symbols

1: plate cylinder
2: printing plate
11: plate cylinder main body
12: lid portion
13: flat portion
14: hole portion
15: plate fixing member
18: air ejection hole
100: plate driving shaft

The invention claimed is:

1. A plate cylinder to be attached to a rotationally driven plate driving shaft and configured to mount a cylindrical printing plate thereon from a tip end side of the plate cylinder, the plate cylinder comprising:

a plate cylinder main body having a plate mounting surface on which the printing plate is to be mounted;

a flat portion formed into a flat surface positioned radially inner than the plate mounting surface on an outer peripheral surface of the plate cylinder main body along an axial direction;

the outer peripheral surface of the plate cylinder main body includes the plate mounting surface and the flat portion formed as a single surface;

a plurality of hole portions formed in the flat portion side by side in the axial direction in a separated state, wherein the plurality of hole portions are through-holes; and a plurality of plate contacting members configured to closely contact the printing plate to the plate mounting surface, wherein the plurality of plate contacting members are positioned in the flat portion and move along with a plurality of eccentric cams provided on a rotating shaft, wherein a plate contacting member of the plate contacting members is fitted in a hole portion of the plurality of hole portions from an inner side of the plate cylinder so as to be movable radially inward and outward of the plate cylinder, and wherein when the plate contacting member is moved radially outward of the plate cylinder, the plate contacting member having a plate contact surface that is arranged to come into contact with an inner peripheral surface of the printing plate, and when the plate contacting member is moved radially inward of the plate cylinder, the plate contacting member becomes approximately parallel to the surface of the flat portion.

2. The plate cylinder as recited in claim 1, wherein the plate contacting member is configured such that an outer peripheral surface of the plate contacting member is movable within a range inner than an inner surface of the printing plate mounted on the plate mounting surface.

3. The plate cylinder as recited in claim 1, wherein the plate contacting member is configured to be fixable at an arbitrary position within a range inner than an inner surface of the printing plate mounted on the plate mounting surface.

4. The plate cylinder as recited in claim 1, wherein an inner portion of the plate cylinder is formed in a hollow shape.

5. The plate cylinder as recited in claim 1, wherein the plate cylinder main body is provided with an air ejection hole at a position away from a tip end side by 20 mm to 50 mm, and a surface roughness Ra of the plate cylinder main body is set to 0.025 μm to 0.5 μm.

6. The plate cylinder as recited in claim 5, wherein a plurality of the air ejection holes is arranged in a circumferential direction on the tip end portion side.

7. A method of attaching and detaching a printing plate with respect to the plate cylinder as recited in claim 5, wherein attaching and detaching the printing plate with respect to the plate cylinder is performed while ejecting air through the air ejection hole.

* * * * *